United States Patent [19]

Bitgood et al.

[11] 3,932,908

[45] Jan. 20, 1976

[54] PORTABLE SCRUBBING DEVICE

[75] Inventors: Andrew J. Bitgood; Roger T. Bellavance, both of Moosup, Conn.

[73] Assignee: The Raymond Lee Organization, Inc., New York, N.Y. ; a part interest

[22] Filed: Mar. 20, 1974

[21] Appl. No.: 452,965

[52] U.S. Cl. ..... 15/28; 132/73.6

[51] Int. Cl.[2] ..... A46B 13/02

[58] Field of Search ..... 15/22 R, 22 A, 22 C, 23, 15/24, 28, 29, 34, 93, 97 R, 3.53; 132/73.6, 75.8; 51/170 R, 170 PT, 170 T; 173/170

[56] References Cited

UNITED STATES PATENTS

| | | | |
|---|---|---|---|
| 1,669,560 | 5/1928 | Himes | 15/28 X |
| 2,008,920 | 7/1935 | Moir | 15/28 UX |
| 2,917,023 | 12/1959 | Cohen | 15/3.53 |
| 3,183,891 | 5/1965 | MacDonald | 15/3.53 |
| 3,242,516 | 3/1966 | Cantor | 15/28 |
| 3,563,252 | 2/1971 | Spohr et al. | 132/73.6 |
| 3,715,770 | 2/1973 | Gomez | 15/28 |

FOREIGN PATENTS OR APPLICATIONS

| | | | |
|---|---|---|---|
| 1,267,147 | 6/1961 | France | 15/28 |

*Primary Examiner*—Edward L. Roberts
*Attorney, Agent, or Firm*—Howard I. Podell

[57] ABSTRACT

A portable scrubbing device incorporating a rotary scrubbing brush detachably mounted in a handle member powered by a flexible cable driven by a motor mounted in a housing unit. The housing unit is fitted with external recesses for storing the handle member and scrubbing brush.

1 Claim, 4 Drawing Figures

PORTABLE SCRUBBING DEVICE

SUMMARY OF THE INVENTION:

Our invention relates to a portable scrubbing device and particularly to a scrubbing device in which a detachable rotary scrub brush is fitted to a handle member linked by a flexible drive cable to a motor in the housing of the device.

The housing unit is fitted with external recesses shaped to retain the handle member and scrub brush, when not in use.

BRIEF DESCRIPTION OF THE DRAWING:

The objects and features of the invention may be understood with reference to the following detailed description of an illustrative embodiment of the invention, taken together with the accompanying drawings in which.

Figure 1:
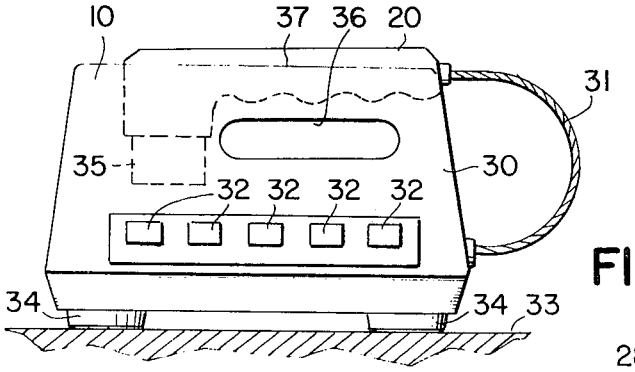
FIG. 1 is a perspective view of the invention.

DESCRIPTION OF THE PREFERRED EMBODIMENT:

Turning now descriptively to the drawings, in which similar reference characters denote similar elements throughout the several views, FIG. 1 illustrates the appliance 10 in the stored position, with handle member 20 held in shaped recess 28 of the housing unit 30 and joined by flexible drive cable 31 to the motor and gear unit 42 located in the housing unit 30.

Figure 2:
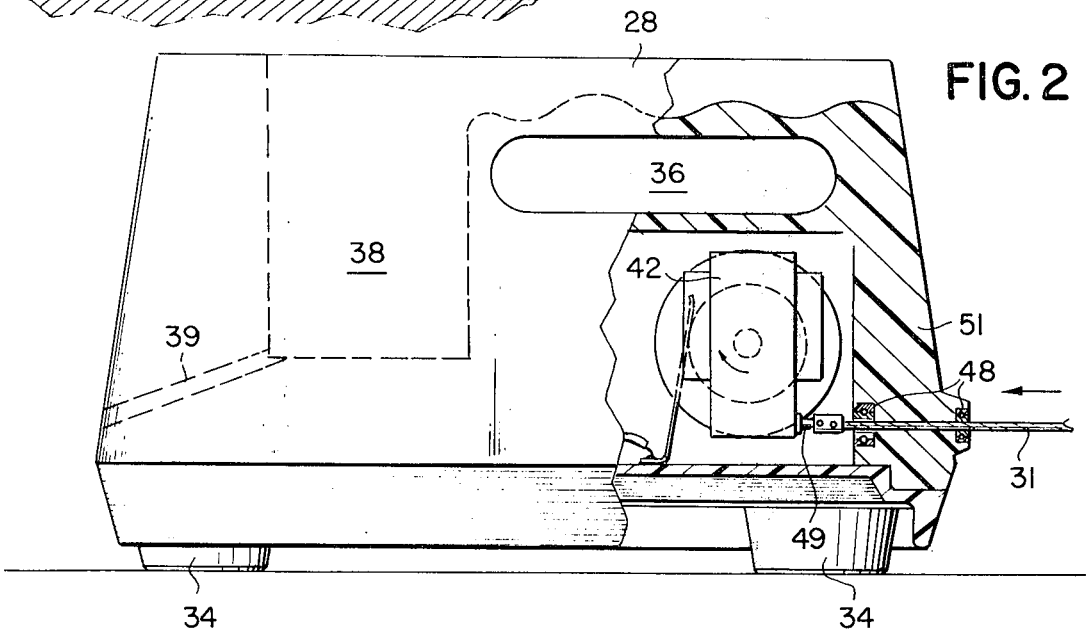
FIG. 2 is a sectional elevation view of the housing.
Figure 3:
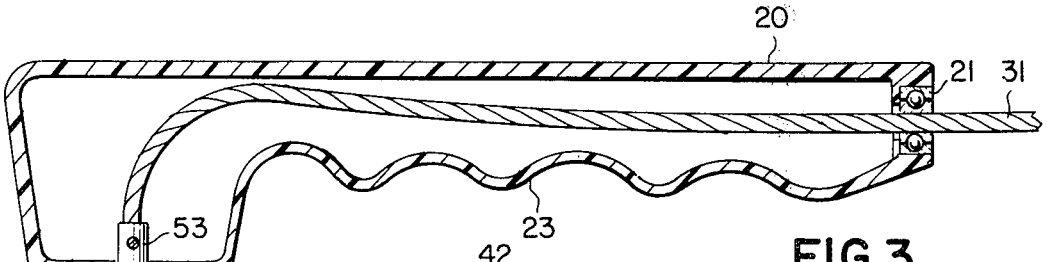
FIG. 3 is a sectional exploded view of the handle member and scrub brush.

As shown in FIGS. 1–3, the housing unit 30 is mounted on fixed legs 34 so as to rest on a horizontal surface 33. Switch buttons 32 on the side of the housing unit permit the operator to turn the device ON or OFF, as well as select the desired speed of motor. A shaped recess 28 in the upper surface 37 of the housing unit 30 of a size to engage the handle member 20 is joined to a shaped recess well 38 of a size to fit about a rotary scrub brush 35 attached to the handle member 20. A drain hole 39 runs from the interior bottom of recess well 38 to the exterior of the housing unit to permit water to drain from a stored brush 35 in the well 38.

Figure 4:
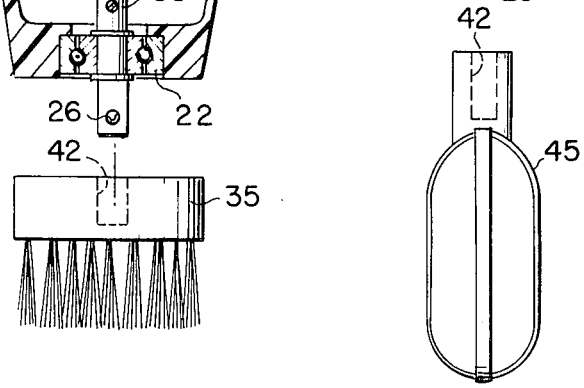
FIG. 4 is an elevation view of an optional stirrer attachment.

Drive shaft 31 is joined in the housing unit to the output shaft 49 of the motor and gear unit and held by rotary bearings 48 in the housing wall 51. The drive shaft 31 is similarly mounted to rotary bearing 21 in the handle member 20 in which it joins the handle output shaft 53 which is mounted in a rotary bearing 22. Output shaft 53 terminates exterior of the handle 20 in a male plug 26 of a size to engage a female socket 42 of a rotary scrub brush 35, shown in FIG. 3 or in optional attachments, such as a stirrer 45 as shown in FIG. 4.

The underside 23 of the handle member 20 is shaped as a grip to fit the fingers of a user holding the handle member 20.

A through hole 36 is fitted in the housing 30 of a size to form a convenient hand grip for lifting the housing.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A compact portable scrubbing or stirring device comprising a housing member, a handle member and a detachable rotary tool, said housing member incorporating a motor and gear unit linked to a flexible drive shaft which leads from the housing member into the handle member, said handle member fitted with an output shaft rotatably mounted to said handle member, said output shaft linked inside the handle member to said flexible drive shaft, with said output shaft shaped, externally of the handle member, to engage a socket in said detachable rotary tool, in which a surface of the housing is formed with a recess of a shape to fit the handle member and an attached detachable rotary tool, with the bottom of said recess linked by a drain hole through the housing to the exterior of the housing, so as to drain excess water from the recess.

* * * * *